United States Patent [19]

Tsals

[11] Patent Number: 5,027,444

[45] Date of Patent: Jul. 2, 1991

[54] DEVICE PROVIDING AUTOMATIC DELIVERY OF TOILET BOWL FRESHENER

[75] Inventor: Izrail Tsals, Princeton, N.J.

[73] Assignee: American Standard Inc., New York, N.Y.

[21] Appl. No.: 479,795

[22] Filed: Feb. 14, 1990

[51] Int. Cl.[5] ..... E03D 9/02

[52] U.S. Cl. ..... 4/225; 4/228; 4/354

[58] Field of Search ..... 4/223–228

[56] References Cited

U.S. PATENT DOCUMENTS

| | | | |
|---|---|---|---|
| 3,105,245 | 10/1963 | Finkbiner | 4/228 |
| 3,181,731 | 5/1965 | Ellis | 4/227 X |
| 3,311,931 | 4/1967 | Kristensen et al. | 4/227 |
| 3,407,412 | 10/1968 | Spear | 4/228 |
| 3,444,566 | 5/1969 | Spear | 4/228 |
| 4,064,572 | 12/1977 | Wicks et al. | 4/228 X |

*Primary Examiner*—Charles E. Phillips
*Attorney, Agent, or Firm*—Blum Kaplan

[57] ABSTRACT

A toilet bowl freshening device for automatically delivering toilet bowl freshener to a toilet bowl after each flush. The device is used in conjuction with the water forced out of a hydraulic actuation system after flushing has occurred. The water activates a freshener pellet and supplies an amount of freshener directly to the bowl.

8 Claims, 12 Drawing Sheets

DEVICE PROVIDING AUTOMATIC DELIVERY OF TOILET BOWL FRESHENER

BACKGROUND OF THE INVENTION

The present invention is generally directed to the freshening of toilet bowl water through a device activated by a flushing mechanism and, in particular, to a device which automatically delivers toilet bowl freshener for use in connection with the hydraulic actuation system of a flushing mechanism.

Conventional flushing mechanisms used in toilet flushing operations generally use one of two different approaches to remove waste material from the toilet bowl. In a first approach, siphoning action is utilized to create a vacuum which draws bowl water and waste into the drain line and refills the bowl with fresh water. In a second approach which is typically used in household applications, a tank on the toilet bowl holds a predetermined amount of water which, when released, generates a high velocity flow to carry bowl water and waste into the drain line and refill the bowl with fresh water. The second approach relies on the weight of the water due to gravity to flush and replenish the bowl.

Since the weight of the water alone is utilized to flush and replenish the bowl, conventional toilets using this conventional system require about 14 to 16 liters during each flushing operation. Because of the concern for water conservation in general and the ever increasing passage of legislation requiring reduced water consumption in toilet flushing operations, it has become imperative that appropriate flushing mechanisms be developed and implemented to insure reduced water consumption during such toilet flushing operations. However, it is also important that such new flushing devices be adaptable for use in existing tanktype toilets.

An attempt has been made to reduce water consumption by increasing the pressure provided by the water in the toilet tank. One such system is shown in U.S. Pat. Nos. 3,677,294 and 3,817,279. The systems disclosed in these patents utilize a pressure storage vessel, initially containing air at atmospheric pressure, which is filled with water at an elevated pressure thereby compressing the air in the tank. During the flush cycle, the air expands rapidly, exerting an additional force on the stored water thereby driving the stored water through the bowl at high velocity. Through the use of a such a system, less water is generally required during each flushing operation.

Systems such as those described in the above-cited U.S. patents have proven less than completely satisfactory for two reasons. First, since the internal volume of the pressure storage vessel must be sufficient to contain both the water required for the flush and compressed air, the vessel must be oversized, thereby requiring a larger water tank than is found on conventional toilets. Second, since the potential energy of the stored water is a function of inlet water line pressure, flushing performance will decrease at pressures substantially below the design pressure of the system.

In co-pending U.S. patent application serial No. 07/440,363, filed Nov. 30, 1989, entitled Flushing Mechanism with Low Water Consumption now U.S. Pat. No. 4,984,311, and co-pending U.S. patent application serial No. 07/522,010, filed on even date herewith entitled Flushing Mechanism Using Phase Change Fluid now U.S. Pat. No. 5,005,226, both of which are assigned to the same Assignee as the present application, several new flushing mechanisms which store potential energy and hydraulic actuation therefor are described which overcome the disadvantages inherent in the prior art. After hydraulic initiation of the flush in such mechanisms, a small amount of water is left over in the hydraulic device which is forced into and through the drain line into the toilet bowl.

Toilet bowl fresheners which freshen the water in a toilet bowl generally are provided in two forms. In a first form, a pellet or dispenser of freshener is disposed directly in the toilet bowl itself and freshens the water therein when wetted by water entering the bowl during flushing. In a second form, a pellet or container of freshener is provided in the toilet tank. When the tank fills or empties with water, the freshener is released and diluted by the tank water and then discharged into the toilet bowl during each flush. Such conventional fresheners are less than completely satisfactory since they are used out rapidly when wetted and dissolved by the full amount of fresh water used to flush the bowl.

Accordingly, it is desired to provide a toilet bowl freshener which can be charged by the small amount of water draining out of a hydraulic actuation device during each flushing cycle.

SUMMARY OF THE INVENTION

Generally speaking, in accordance with the present invention, a device for automatic delivery of toilet bowl freshener for use in conjunction with a hydraulically actuated flushing mechanism, is provided. The flushing mechanism is actuated by a hydraulic device in which a predetermined amount of water supplied to the hydraulic device is used to initiate the flush cycle to flush a toilet bowl and supply fresh water thereto. The improvement includes a freshening device having a container which holds a predetermined amount of toilet bowl freshener. The container includes a first opening through which a portion of the predetermined amount of water from the hydraulic device is received to wet the toilet bowl freshener contained therein to form an admixture of freshener. The container also includes a second opening through which at least a portion of the admixture of freshener is discharged into the toilet bowl. The freshener is supplied directly to the toilet bowl during each flushing operation at the end of the flush cycle.

Accordingly, it is an object of the present invention to provide an improved device for the automatic delivery of toilet bowl freshener.

A further object of the present invention is to provide a device for automatically delivering toilet bowl freshener to a toilet bowl which is charged by the water used during hydraulic actuation of a flushing mechanism.

Another object of the present invention is to provide a device for delivering toilet bowl freshener to a toilet bowl which uses a minimal amount of water to activate the freshener.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Before turning to a detailed description of the device for automatic delivery of toilet bowl freshener in accordance with the present invention, several flushing mechanisms in which the toilet bowl freshener device can be incorporated will first be described.

Figure 1:
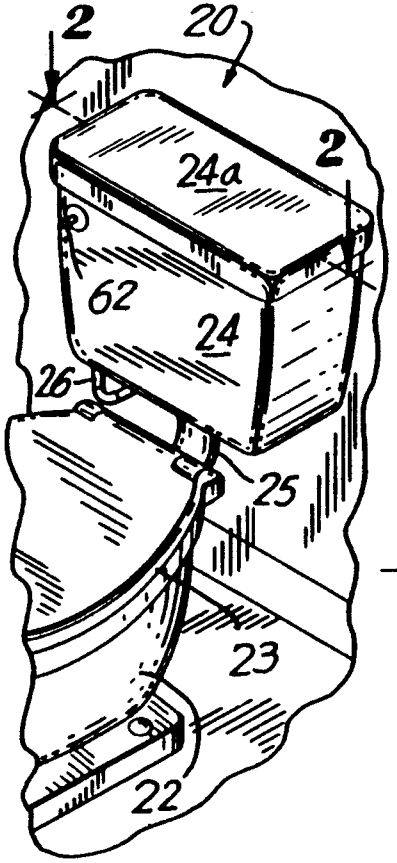
FIG. 1 is a partial perspective view of a conventional toilet incorporating an improved flushing mechanism and hydraulic actuation system therefor constructed for use with the device for automatic delivery of toilet bowl freshener in accordance with the present invention.
Figure 3:
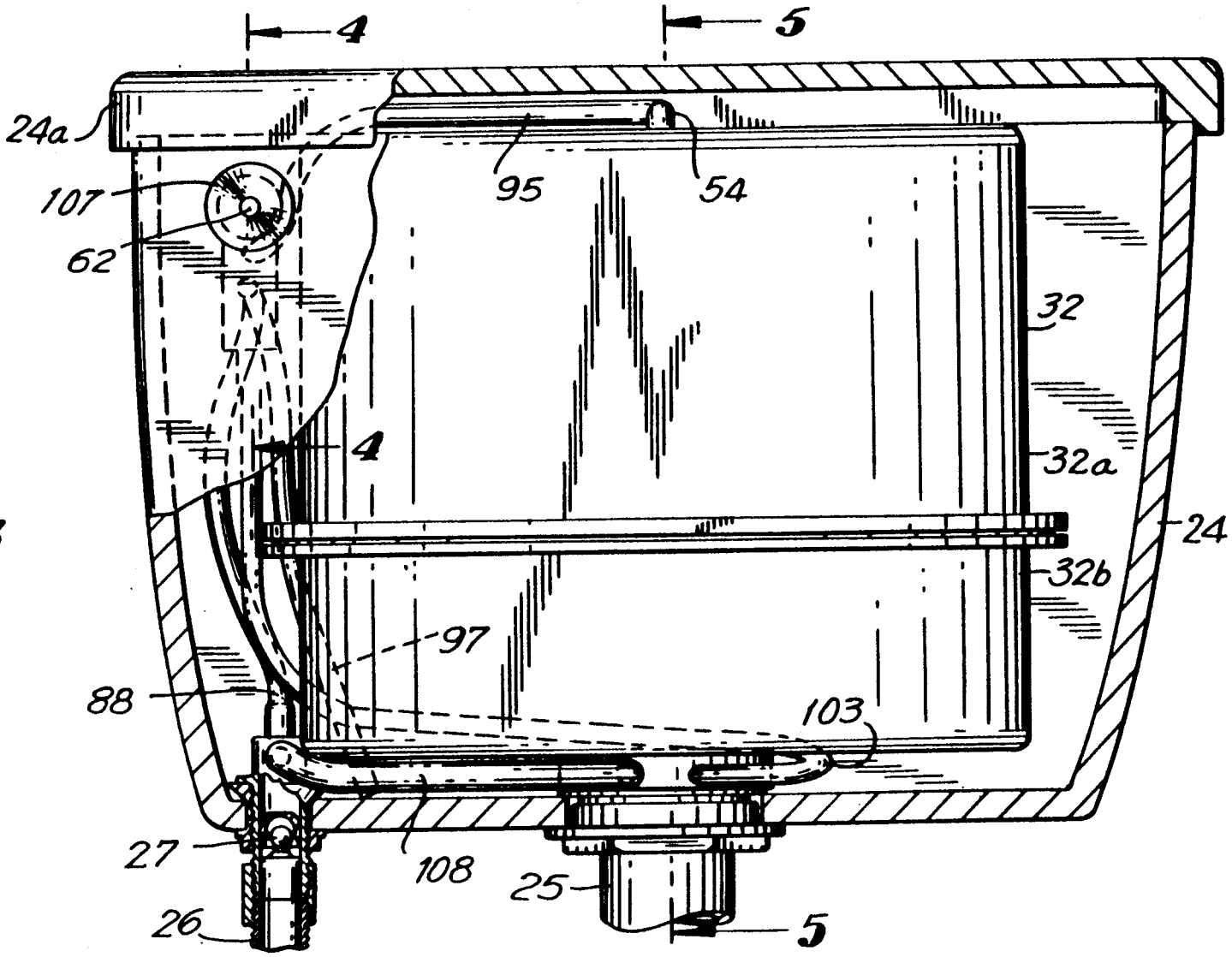
FIG. 3 is a sectional view taken along lines 3—3 of FIG. 2.

Reference is first made to FIG. 1 which depicts a conventional toilet, generally indicated at 20, incorporating a first embodiment of the toilet flushing mechanism. Toilet 20 includes a toilet bowl 22 having a toilet seat and cover 23 pivotably coupled thereto and a tank 24 with a removable cover 24*a*coupled to bowl 22 through a drain line 25. Fresh water is provided to tank 24 at main pressure through water supply line 26.

In a conventional toilet such as toilet 20 depicted in FIG. 1, tank 24 is adapted to hold between about 14 to 16 liters of water which amount of water is required to flush bowl 22 of waste material and replenish same with fresh water during each flushing operation. The first embodiment of the flushing mechanism utilizes a conventional toilet 20 but provides an internal system to be placed in tank 20 after the old components are removed to permit substantially less water (about 4½to 6 liters) to be utilized during each flushing operation.

Reference is now made additionally to FIGS. 2 through 7 for use in explaining the first embodiment of a flushing mechanism, generally indicated at 30. Flushing mechanism 30 includes a containment or storage vessel 32 adapted to hold between about 4½ and 6 liters of water or other liquid, and a hydraulic actuation system, generally indicated at 60, which is also used to activate the toilet freshening device of the present invention as described below in detail. Actuation system 60 includes an actuator button 62.

Figure 5:
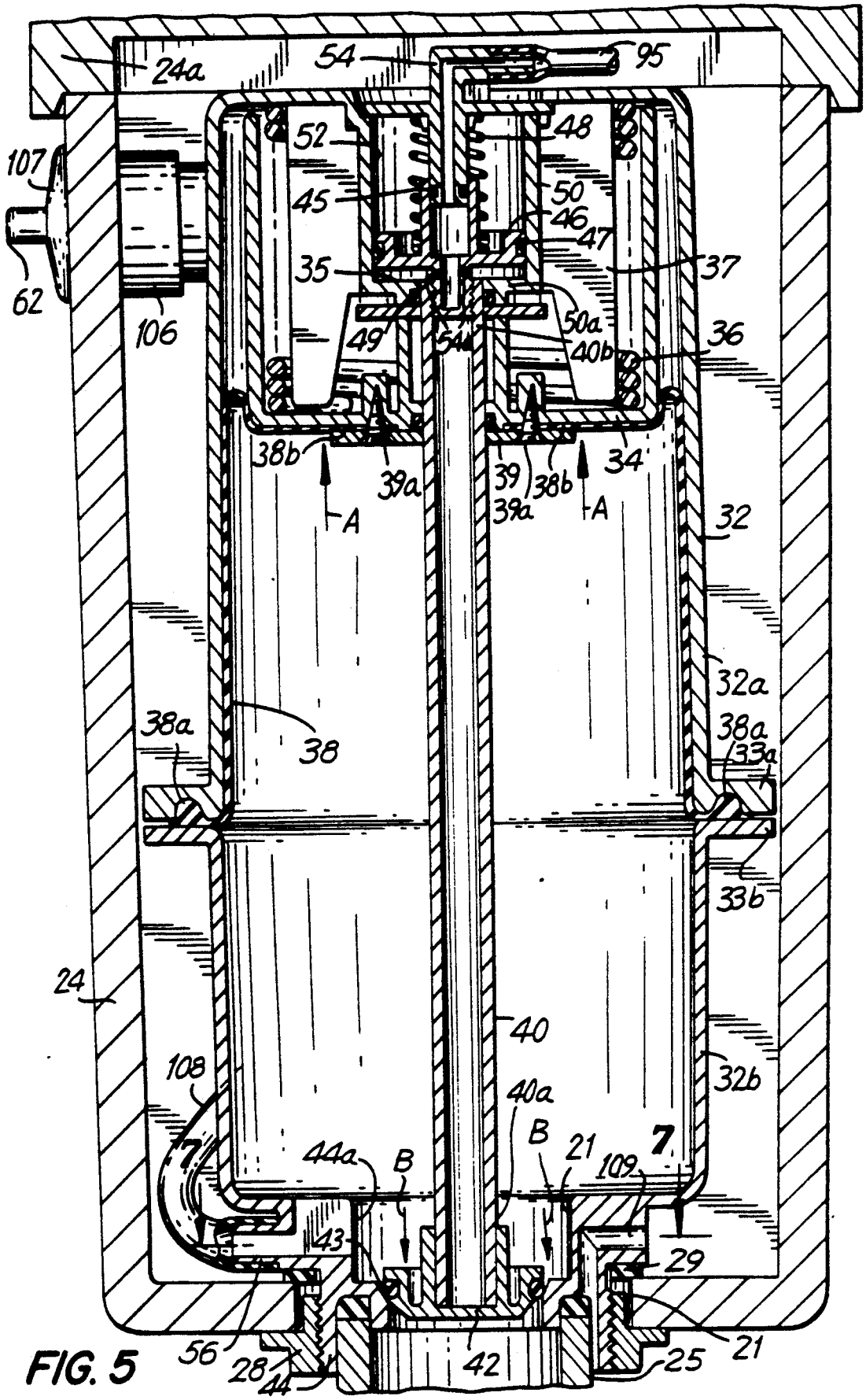
FIG. 5 is an enlarged sectional view taken along line 5—5 of FIG. 3.

Referring specifically to FIG. 5, it is seen that containment vessel 32 is an enclosed elliptical chamber (cylindrical in cross section) defined by a first section 32*a* and a second section 32*b* which are joined together at flanges 33*a* and 33*b*. A piston 34 is biased within containment vessel 32 by means of a mechanical compression piston spring 36. Piston spring 36 is supported around a supporting member 37. A rolling diaphragm 38 includes a first end 38*a* which is captured between flanges 33*a* and 33*b* and a second end 38*b* which is held to piston 34 by means of a plate 39 and appropriate fastening means such as screws 39*a*.

A flush valve body 44 is defined at the bottom of containment vessel 32 and includes a central opening 44*a* therethrough. Containment vessel 32 is held to tank 24 through an opening 21 therein by means of a threaded nut 28 secured to flush valve body 44. A gasket 29 may be used to prevent leaks. Containment vessel 32 is sized to fit in a standard-sized toilet tank of about 14 liters.

A flush valve stem 40 extends along a central portion of containment vessel 32 and includes a first end 40*a* and a second end 40*b*. A flush valve 42 is coupled to first end 40*a* of flush valve stem 40 and includes a flush valve seal ring 43 which releasably seals flush valve 42 against flush valve body 44 to prevent water or other liquid within containment vessel 32 from escaping through drain line 25 until flushing is actuated, as described below in detail.

A flush valve plate 46 is coupled to second end 40*b* of flush valve stem 40. Flush valve plate 46 is normally biased in a lower position as depicted in FIG. 5 by means of flush valve spring 48. Flush valve plate 46 includes a second flush valve seal ring 47 which seals flush valve plate 46 against a wall 50 which defines a closed flush valve initiation chamber 52 A third seal ring 45 and a fourth seal ring 49 are also provided to prevent leaking.

A flush valve fitting 54 extends into initiation chamber 52 to permit water provided by flush actuation system 60 to fill flush initiation chamber 52 as described below in detail. Containment vessel 32 also includes a refill valve fitting 56 at the bottom thereof to permit water or other liquid under main supply pressure to refill containment vessel 32 as also described below in detail. The system may include a pressure regulator to reduce the water supply pressure, if necessary.

When flush valve 42 is closed to seal off containment vessel 32 from drain line 25, and water fills containment vessel 32, piston 34 will be forced in an upward direction in the direction of arrows A against the force of piston spring 36 to compress same. The water within containment vessel 32 will also act to assist in forcing flush valve seat 42 in a downward direction as shown by arrows B. In addition, it is noted that flush valve plate 46 is in its lower position and defines a small gap 35 with bottom wall 50*a* of initiation chamber 52 (FIG. 5).

Figure 4:
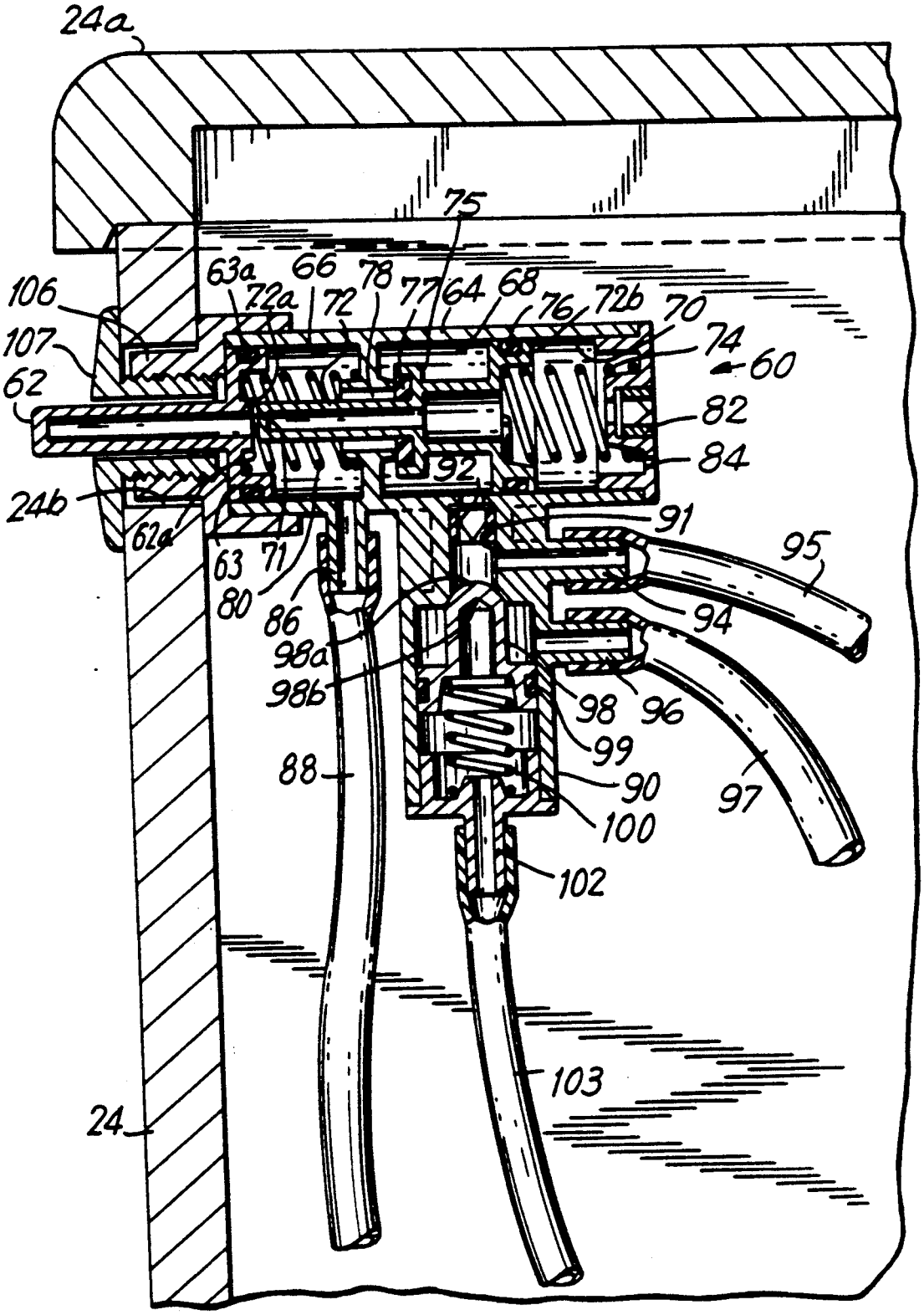
FIG. 4 is an enlarged sectional view taken along line 4—4 of FIG. 3.

Reference is now made to FIG. 4 which depicts hydraulic actuation system 60 in detail. Actuation system 60 includes an actuator valve body 64 defining an actuator valve chamber 66, a reseal valve chamber 68 and a reseal timing chamber 70. Actuator button 62 terminates in an actuator plate 63 which includes a sealing ring 63*a* which seals actuator plate 63 against the interior wall defining actuator valve chamber 66. A reseal valve stem 72 includes a first end 72*a* which is normally spaced by a small gap 71 from first end 62*a* of actuator button 62 under the force of reseal valve return spring 74 and an enlarged second end 72*b* which includes a sealing ring 76 which rides against the interior surface defining reseal timing chamber 70. Reseal valve stem 72 also includes an interior plate 75 which includes a sealing washer 77 which presses against an interior shoulder 78 when reseal valve stem 72 is in the position depicted in FIG. 4.

An actuator button return spring 80 normally biases actuator button 62 in an outward direction. Actuator valve body 64 includes a reseal timing check valve 82 and reseal timing orifice 84. Actuator valve body 64 also includes an actuator supply line fitting 86 which is coupled through an actuator supply line 88 to water supply line 26 (FIG. 3) which supplies water under pressure to actuator supply line 88.

Figure 2:
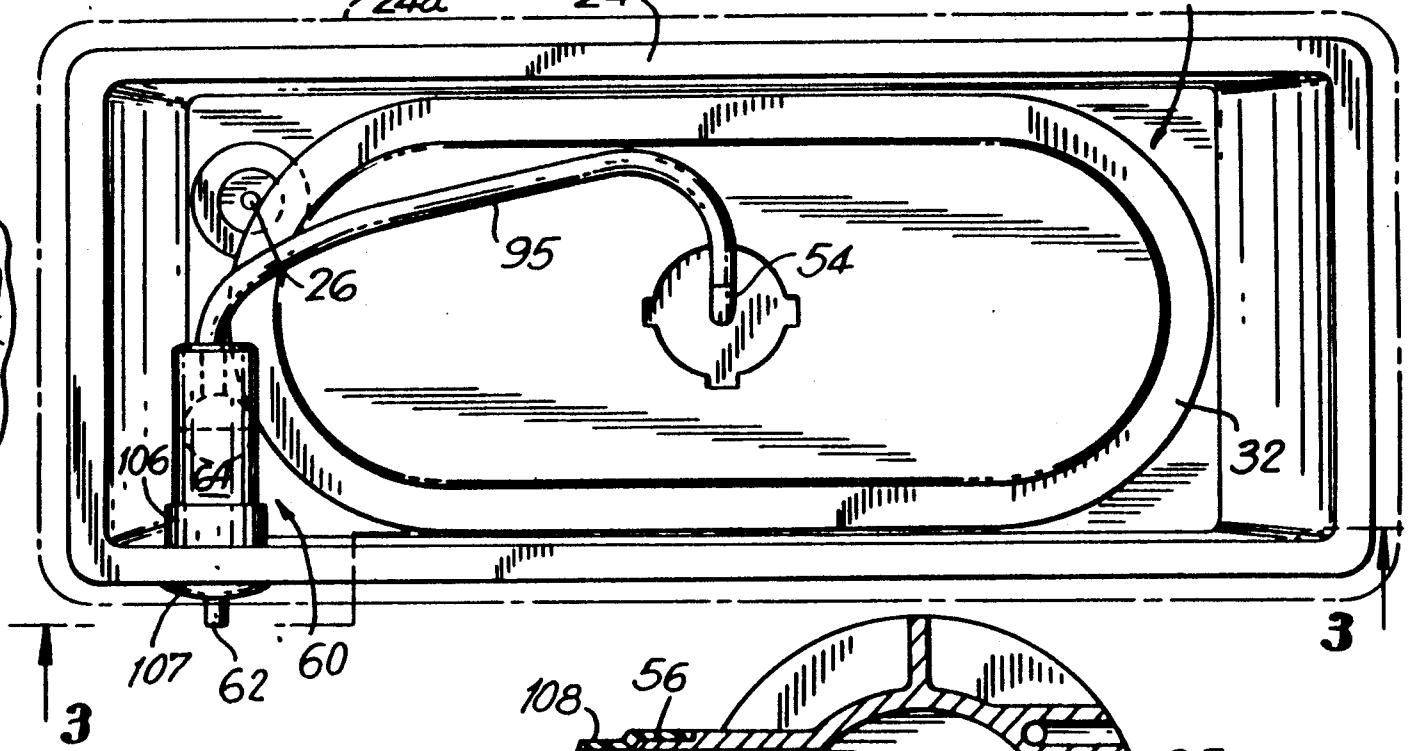
FIG. 2 is an enlarged section view taken along line 2—2 of FIG. 1.

Actuator valve body 64 includes an extension 90 which includes an interior section 91 which is opened to reseal valve chamber 68 through a drain line check valve 92. Extension 90 includes a flush actuation fitting 94 which is coupled by a flush actuation line 95 to flush valve fitting 54 on containment vessel 32 (FIG. 2). Extension 90 also includes an actuator drain fitting 96 which may include an actuator drain line 97.

Figure 7:
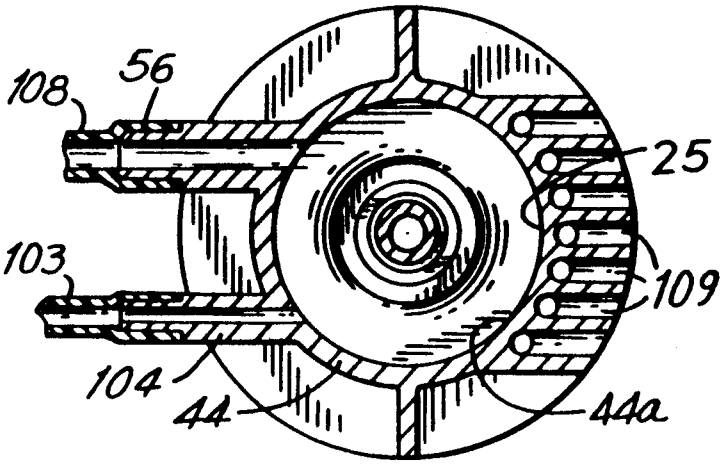
FIG. 7 is a sectional view taken along line 7—7 of FIG. 5.

Interior section 91 of extension 90 also includes a drain line valve 98 having a sealing ring 99 which is normally biased in an upward position by means of a drain line valve return spring 100. A pressure feedback fitting 102 is coupled to a second pressure feedback fitting 104 on flush valve body 44 through pressure feedback line 103 (FIG. 7).

It is noted that flush actuator system 60 is held to tank 24 through an opening 24*b* conventionally found in toilet 20. A nut 106 is fastened to a face plate 107 to affix the system to the tank. It is also noted that a water supply line 108 delivers water under main pressure from water supply line 26 to fill containment vessel 32. Water supply line 26 should include a check valve 27 to prevent dirty waste water from entering the fresh water line. Finally, it is noted that flush valve body 44 includes a plurality of drain line openings 109 which drain any water in tank 24 outside of containment vessel 32 into bowl 22.

Reference is now made to FIGS. 2 through 7 to provide an explanation of the operation of flushing mechanism 30 and hydraulic actuation system 60. As shown in FIG. 5, before the flush cycle begins, the system is at rest with containment vessel 32 filled with water, piston 34 in its uppermost position and piston spring 36 compressed. All valves are closed and no water is flowing through the system.

The flush cycle is started by depressing actuator button 62. This action opens r®®®al valVe stem 72 allowing water at system supply pressure in actuator supply line 88 and actuator valve chamber 66 to flow through shoulder 78 into reseal valve chamber 68, through check valve 92 and through fitting 94 into flush actuation line 95. Water under pressure in line 95 flows into fitting 54, through openings 54*a* and into gap 35 in initiation chamber 52 thereby pressurizing the initiation chamber to system supply pressure.

Figure 6:
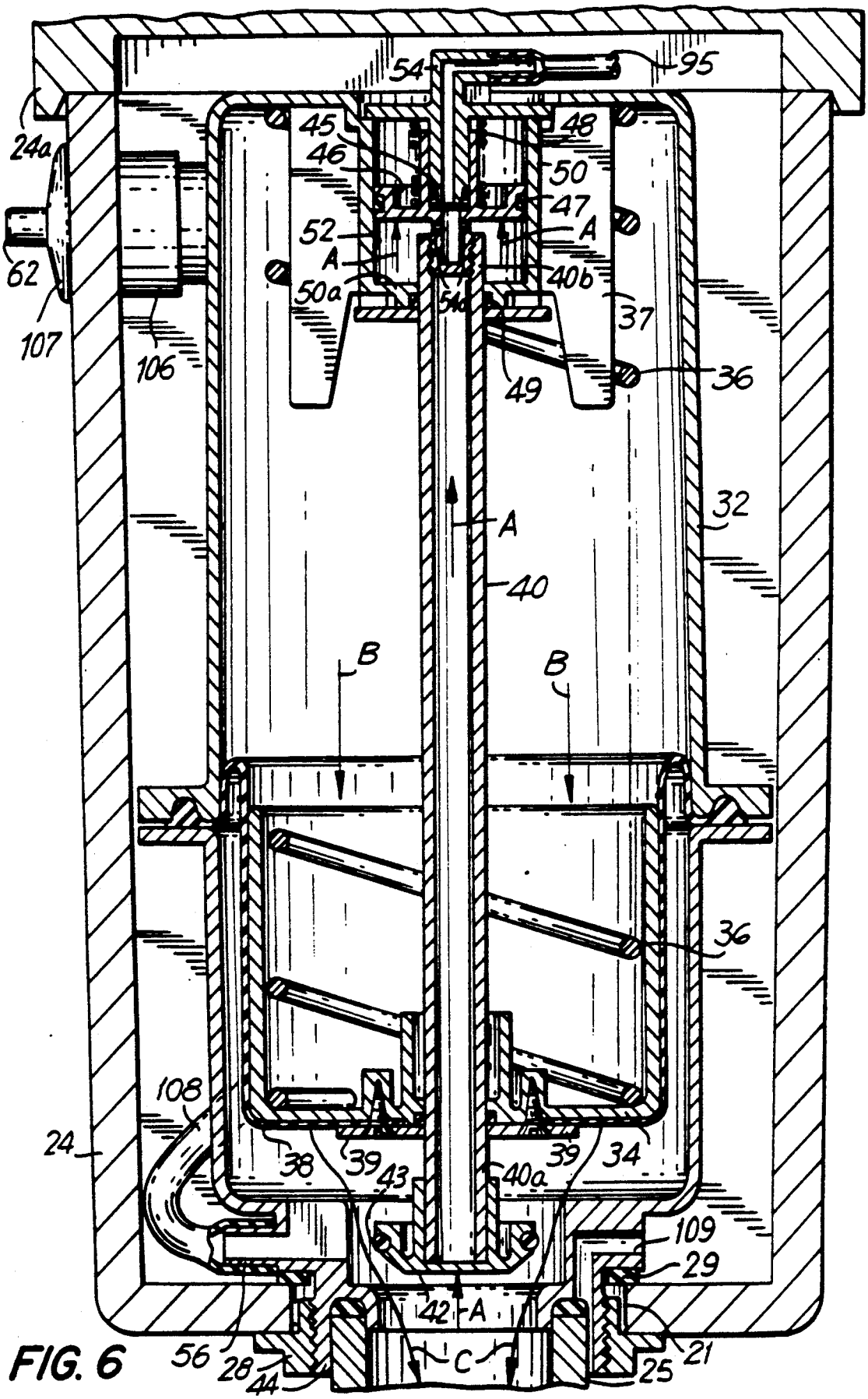
FIG. 6 is a sectional view similar to FIG. 5 but showing the flushing mechanism after the toilet has been flushed.

This water pressure acts against flush valve plate 46 and produces a force which compresses flush valve spring 48 thereby moving flush valve stem 40 upward in the direction of arrow A releasing flush valve 42 from flush valve body 44 as best depicted in FIG. 6. The travel of flush valve plate 46 and hence flush valve stem 40 and flush valve seat 42 is limited to a predetermined compression of spring 48.

When actuator button 62 is released, system supply pressure provided through line 88 acts to restore button 62 to its original position. Spring 80 assists in assuring return of the actuator button especially in an unpressurized system.

When drain line 25 is open to the interior of containment vessel 32 as depicted in FIG. 6, water in the containment vessel will flow rapidly in the direction of arrows C into drain line 25 and hence into toilet bowl 22 under the added pressure exerted by piston 34 on the water under the action of spring 36 as it releases its energy when it relaxes. This action substantially increases the pressure of the water flowing into the toilet bowl thereby providing a superior flush and requiring substantially less water during each flushing operation. In fact, it has been found that only about 4½ to 6 liters of water (as opposed to 14 to 16 liters required in conventional tanks) is all that is required in the present invention to provide complete flushing action.

Rolling diaphragm 38 acts to prevent water in containment vessel 32 from flowing beyond piston 34 and to prevent contact of the water with piston spring 36. However, it is noted that other types of piston isolation means such as a sliding seal, could be utilized. It is also noted that although a compression spring 36 is depicted, an extension spring could also be utilized in a reverse configuration.

While actuator button 62 will immediately return to its original position when released, it is desirable to delay closure of reseal valve stem 72 to insure complete opening and drainage of the flush valve system. Such delay is accomplished in the present invention by a reseal timing system. In particular, at the start of the flushing cycle, depressing of actuator button 62 drives reseal valve stem 72 open, thereby expelling air through reseal timing check valve 82. Return of reseal valve stem 72 to its original position is slowed by the resulting vacuum created in reseal timing chamber 70. The rate at which reseal valve stem 72 is reset is controlled by the rate of flow of air back into reseal timing chamber 70 through reseal timing orifice 84.

In the present embodiment, resealing of flush valve 42 to close off drain 25 is triggered by the decay in pressure inside containment vessel 32 near the end of the flush cycle. When reseal valve stem 72 closes, the pressure in flush actuation line 95 drops below system supply pressure. Since water in flush actuation line 95 and flush initiation chamber 52 represents a closed system, its pressure level is set by the force of flush valve spring 48. This pressure serves as a reference pressure on the upper surface 98*a* of drain line valve seal 98.

The pressure in pressure feedback line 103, acting against the lower surface 98*b* of drain line valve seal 98 is compared to that reference pressure. When pressure within containment vessel 32 drops to a level such that the force from the reference pressure acting against top 98*a* of drain line valve 98 is sufficient to overcome the sum of the forces from the friction created by sealing ring 99, drain line valve return spring 100 and pressure acting against lower surface 98*b* of drain valve 98 from pressure feedback line 103, drain line valve 98 will open. Opening of drain line valve 98 allows flush valve spring 48 to move flush valve stem 40 in a downward direction and hence causes flush valve seat 42 to seat against flush valve body 44 to close off drain line 25. Accordingly, the system acts as a pressure sensing system to sense the end of the flush cycle to close off the flush valve while insuring that the flush valve stays open until flushing is complete. This also acts to conserve water.

A predetermined portion of the water in flush actuation line 95 displaced by the travel of flush valve plate 46 passes through drain line 97 into tank 24. However, as described below in detail, the predetermined portion of water in flush actuation line 95 can be used to activate the toilet bowl freshener device of the present invention. When water in tank 24 reaches a depth above the height of drain 109 in valve body 44, excess water flows through drain 109 into toilet bowl 22.

When the flush valve is closed, water under system pressure from supply line 108 will refill containment vessel 32 thereby moving piston 34 in the direction of arrow A and compressing spring 36 to the condition depicted in FIG. 5. The system is then ready to be reflushed when necessary.

Figure 8:
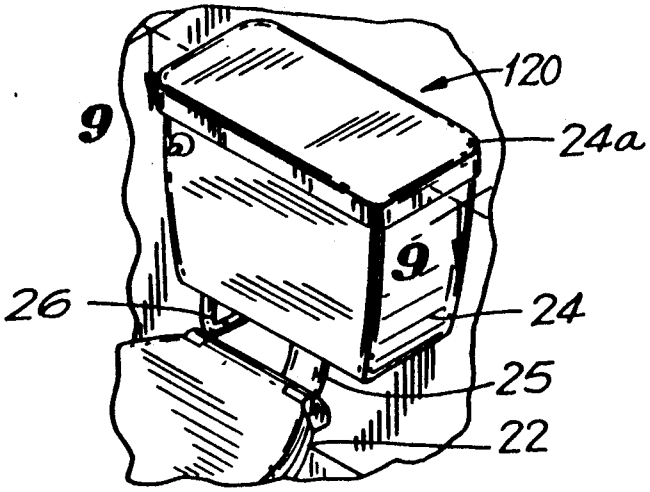
FIG. 8 is a partial perspective view of a conventional toilet incorporating a second improved flushing mechanism and hydraulic actuation system therefor constructed for use with the device for automatic delivery of toilet bowl freshener in accordance with a second embodiment of the present invention.
Figure 9:
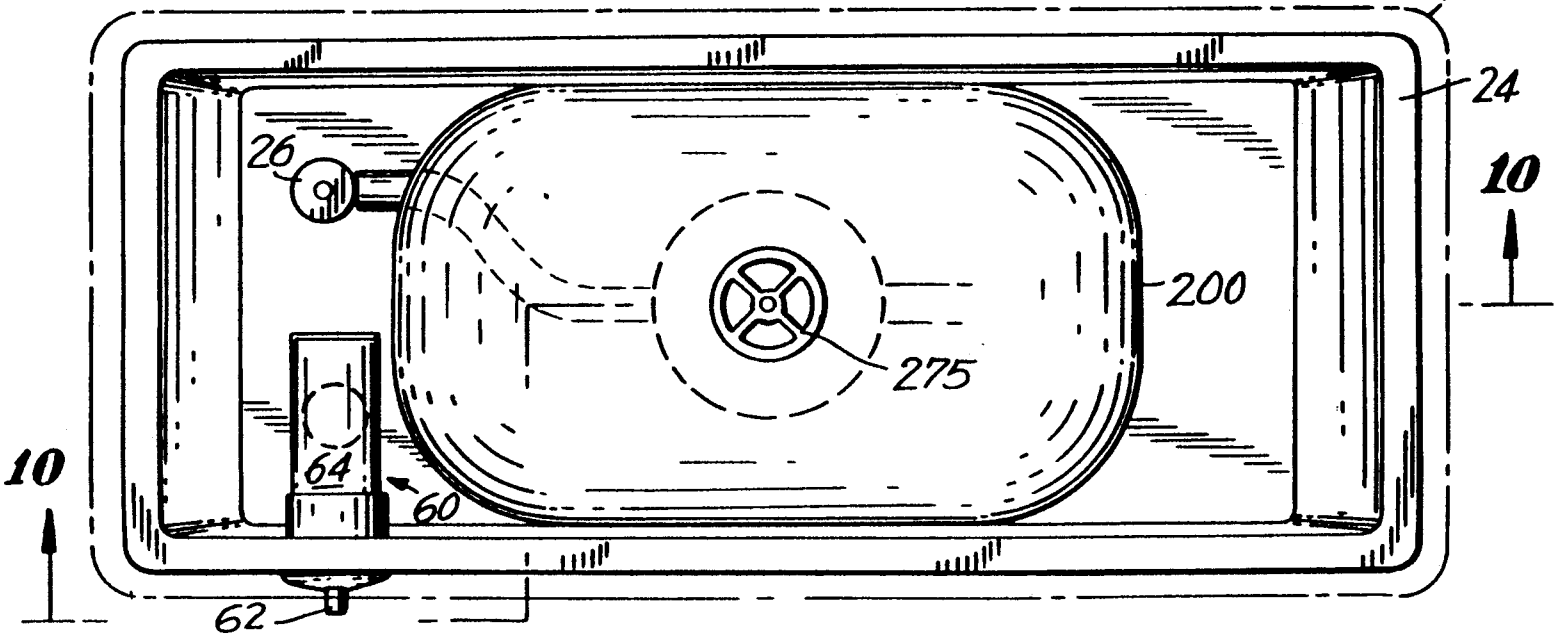
FIG. 9 is an enlarged sectional view taken along line 9—9 of FIG. 8.

Reference is now made to FIGS. 8 through 12 for the purpose of describing a second embodiment of a flushing mechanism for use in connection with the present invention. Like elements in FIGS. 8 through 12 to those shown in FIGS. 1 through 7 are numbered alike. Referring to FIG. 8, a conventional toilet generally indicated at 20 having a toilet bowl 22 and a tank 24 coupled thereto through a drain line 25 is depicted. Water supply line 26 supplies water under main system pressure to tank 24 as described herein. Tank 24 also includes a removable cover 24*a*. Referring to FIG. 9, it is seen that a containment vessel 200 sized to fit within tank 24 and adapted to hold about 6 liters of water or other liquid is provided. Hydraulic actuation system 60 is constructed similarly to actuation system 60 depicted in FIGS. 1 through 7 and likewise can be used to activate the toilet bowl freshener device of the present invention as described below in detail.

Figure 10:
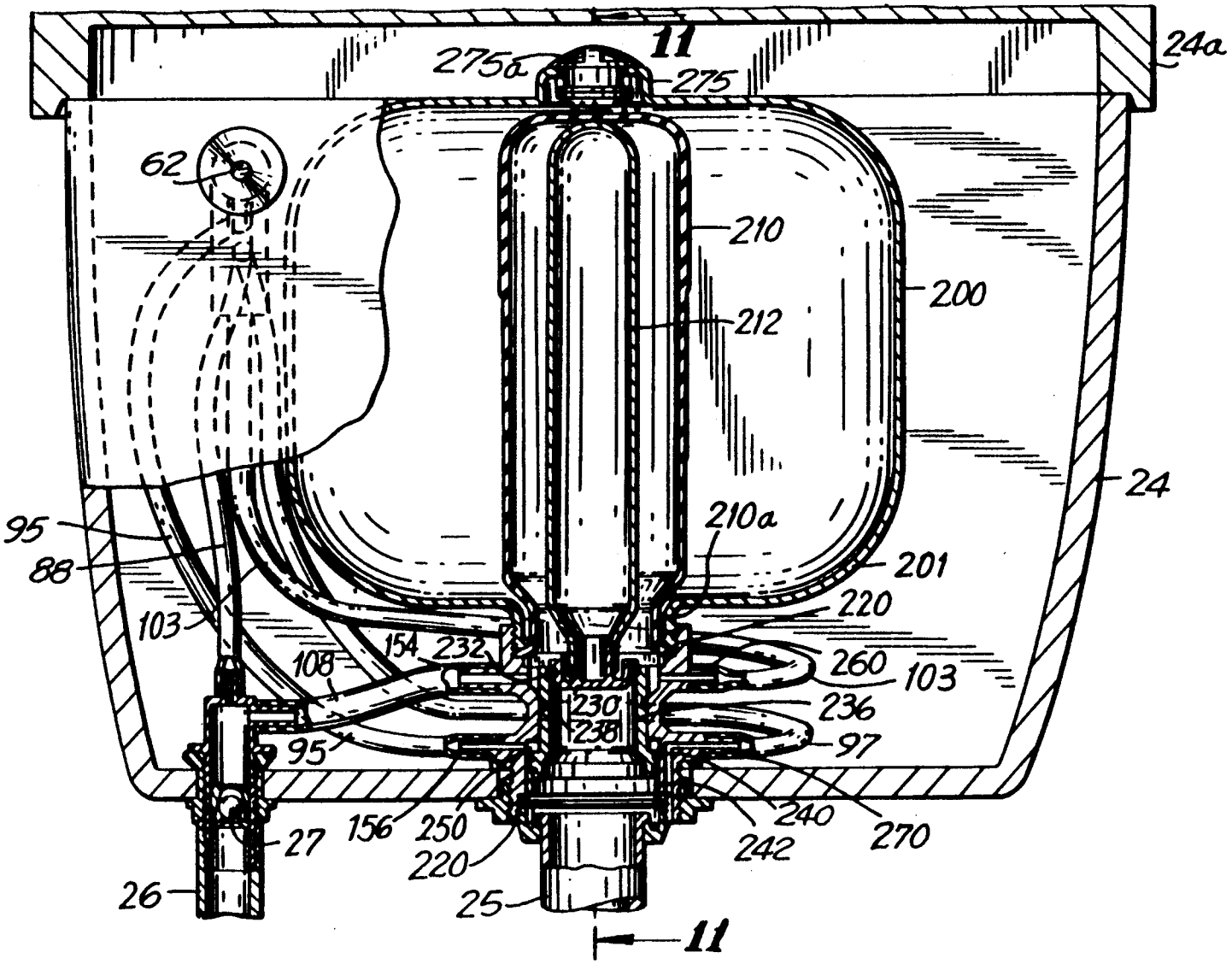
FIG. 10 is a sectional view taken along lines 10—10 of FIG. 9.
Figure 11:
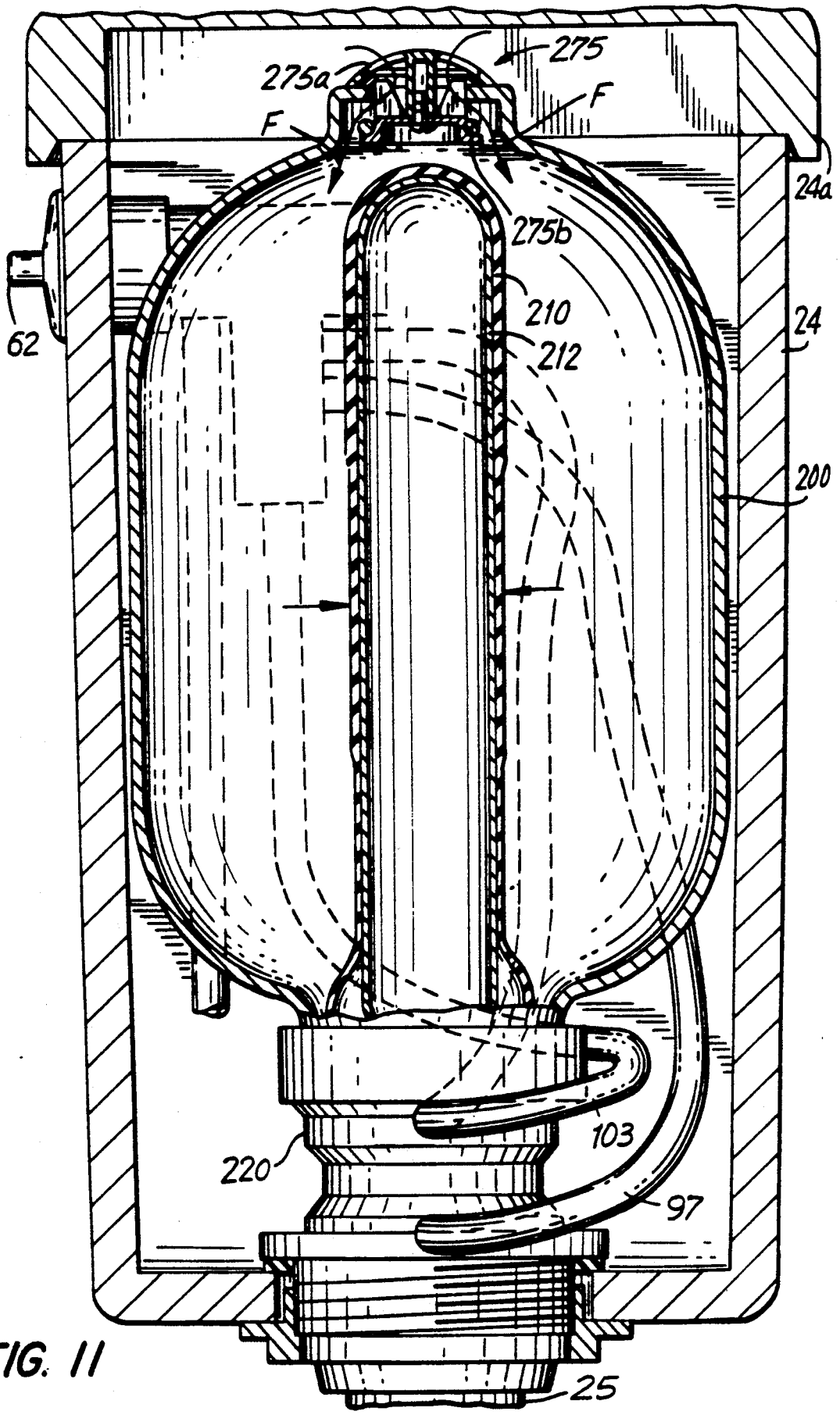
FIG. 11 is an enlarged sectional view taken along line 11—11 of FIG. 10.
Figure 12:
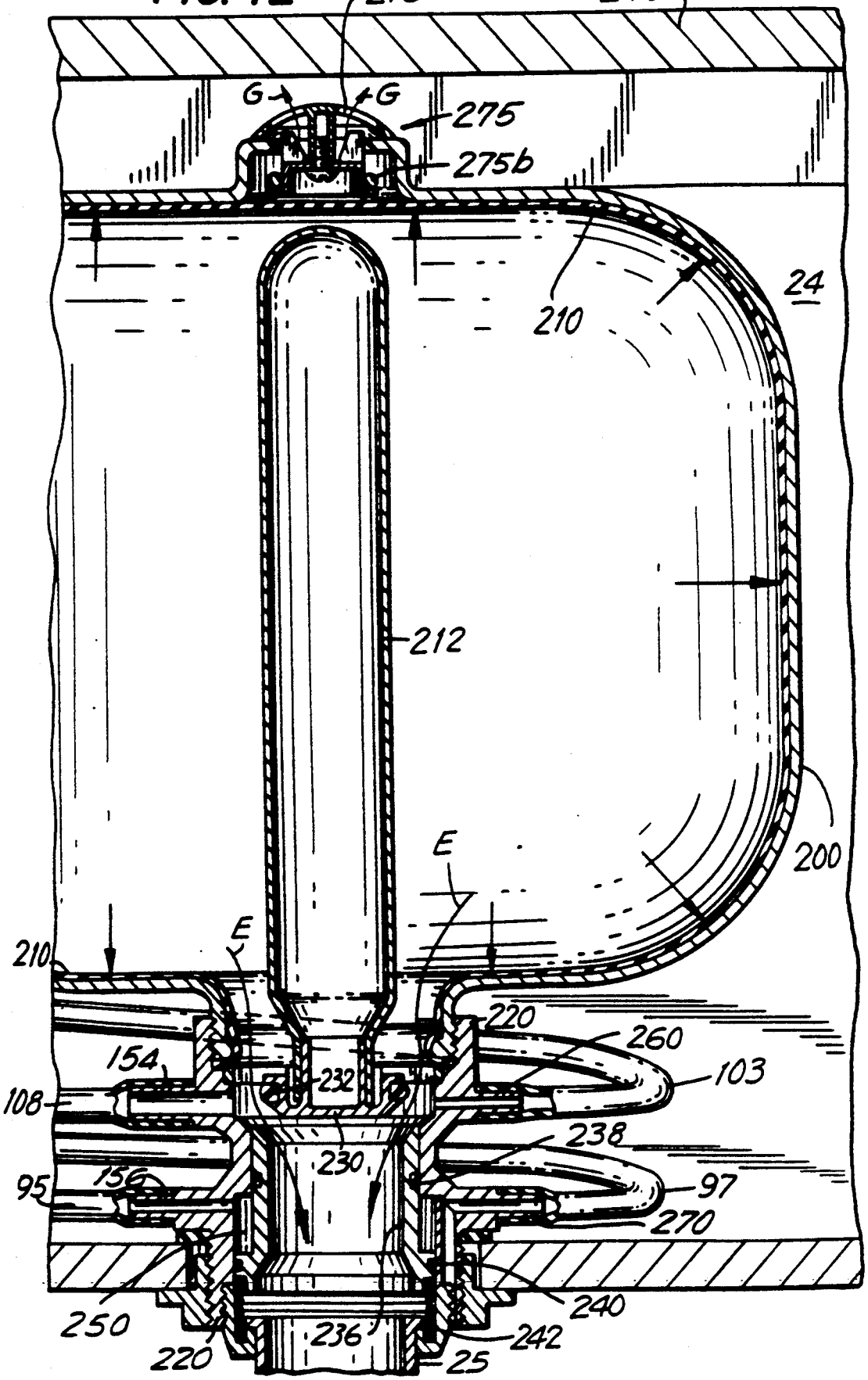
FIG. 12 is an enlarged partial sectional view similar to FIG. 10 but showing an elastic bladder in its expanded and filled condition.

Referring specifically to FIGS. 10 through 12, it is seen that instead of the spring biased piston system depicted in FIGS. through 7, the second embodiment of the present invention utilizes an elastic bladder system to increase water flushing pressure. In this regard, containment vessel 200, also sized to fit in a standard toilet tank of about 14 liter size, includes an internal elastic bladder 210 which, when deflated, is supported by a bladder support tube 212. Bladder 210 is constructed from an appropriate stretchable material such as rubber, the open end 210*a* of which is captured intermediate a wall 201 defining containment vessel 200 and flush valve body 220. In a preferred embodiment, the elastic bladder is made from an EDPM material and is sized to expand about two to four times its unstretched size.

A flush valve seat 230 is fitted on the end of bladder support tube 212 and includes a sealing ring 232 therearound. A displaceable flush valve 236 includes a first sealing ring 238 and a second sealing ring 240. A flush initiation chamber 250 is defined intermediate flush valve 236 and flush valve body 220. Flush valve 236 is normally biased against flush valve seat 230 through the action of a flush valve spring 242 thereby closing off the interior of bladder 210 to drain line 25. Flush valve body 220 includes a refill valve fitting 154 coupled to water supply line 108 and a flush valve fitting 156 coupled to flush actuation line 95. Flush initiation chamber 250 receives water under pressure from flush actuation line 95. Flush valve body 220 also includes a pressure feedback fitting 260 coupled to pressure feedback line 103, and a drain fitting 270 coupled to actuator drain line 97.

In use, the hydraulic actuation system depicted in FIG. 4 and described above may be utilized to actuate the present embodiment. Before the flush cycle is commenced, the system is at rest, with elastic bladder 210 filled with water (about 6 liters) and fully expanded to essentially fill containment vessel 200 as best depicted in FIG. 12. All valves are closed.

The flush cycle is initiated as described above with reference to FIG. 4 by depressing actuator button 62. When actuator button 62 is depressed, flush actuation line 95 will be pressurized under the regular system pressure and will thereby pressurize flush initiation chamber 250 to system supply pressure. This pressure will produce a force to overcome the force exerted by flush valve spring 242 to move flush valve 236 in a downward direction away from flush valve seat 230 as best depicted in FIG. 12 thereby opening the interior of elastic bladder 210 to drain line 25. Water will be forced into drain line 25 around flush valve seat 230 as indicated by arrows E in FIG. 12. The normal pressure of the water due to gravity will be substantially enhanced by the force exerted by the compressing bladder 210. The force exerted by bladder 210 as it compresses permits substantially less water to be utilized to flush and replenish bowl 22 with water. As noted above, only about 6 liters of water are required for each flushing operation.

When the flushing operation is complete and flush valve seat 230 closes against flush valve body 236, water from water supply line 108 will enter through fitting 154 and refill bladder 210 with water. A containment vessel air make-up vent and overflow seal valve 275 at the top of containment vessel 200 includes a displaceable cap 275*a* which permits air to enter vessel 200 when cap 275*a* is in its lower rest position when bladder 210 is deflating as best depicted by arrows F in FIG. 11 as well as to permit air to escape when bladder 210 is inflating as shown by arrows G in FIG 12. However, should bladder 210 burst or leak causing containment vessel 200 to fill with water, vent 275 will close when cap 275*a* rises and gasket 275*b* seals against containment vessel 200 as depicted in FIG. 12 to prevent the release of water from containment vessel 200. In addition, it is noted that the portion of the water in the flush actuator line 103 which is released on closing of the system flows through drain line 97 into drain fitting 270 and directly into toilet bowl 22. It is this portion of water which is used to actuate the toilet bowl freshening device of the present invention as described below.

Figure 13:
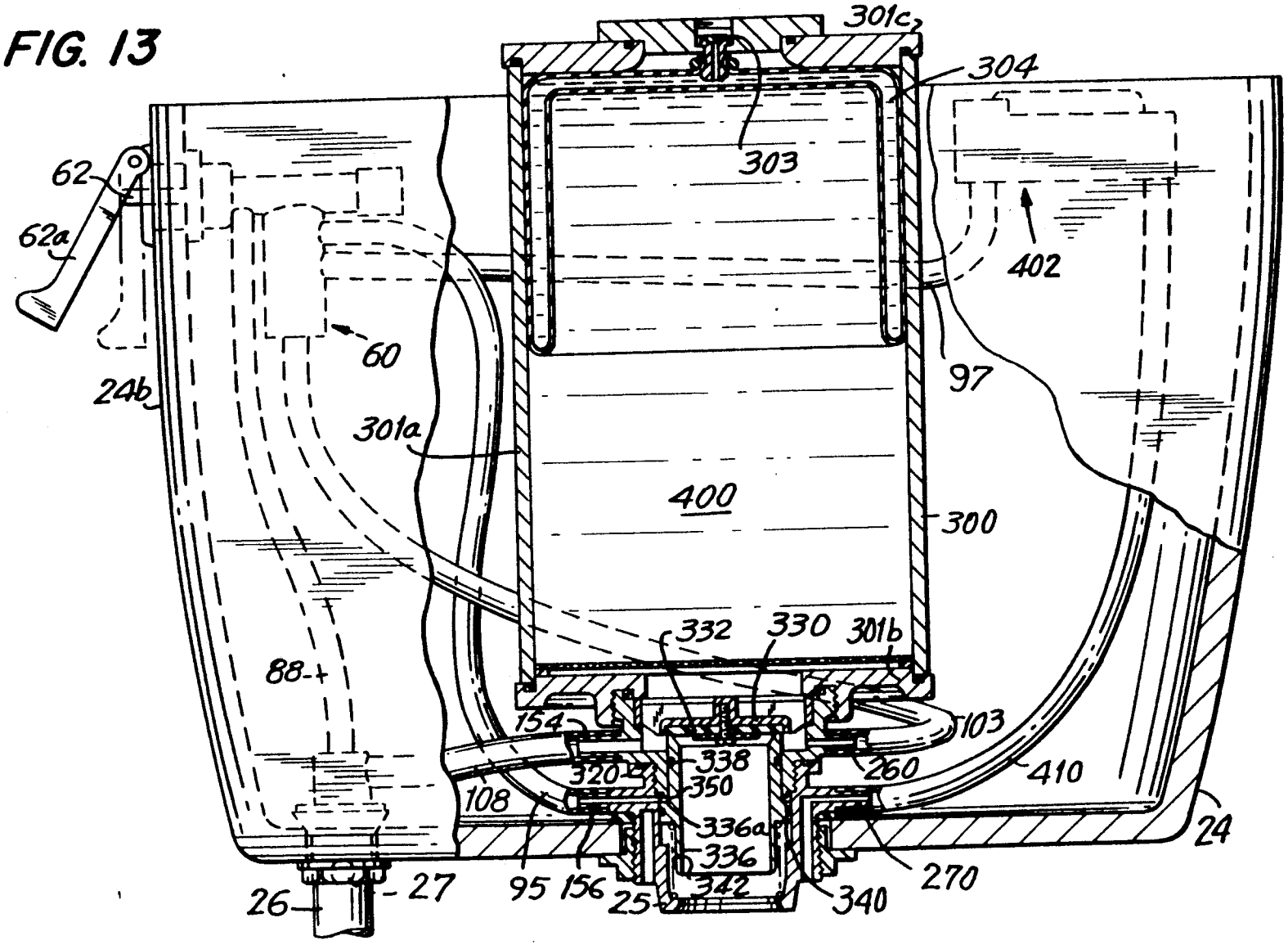
FIG. 13 is a sectional view similar to FIG. 10 but showing the incorporation of a device for automatic delivery of toilet bowl freshener in accordance with the present invention in a third embodiment of a flushing mechanism with hydraulic actuation.
Figure 15:
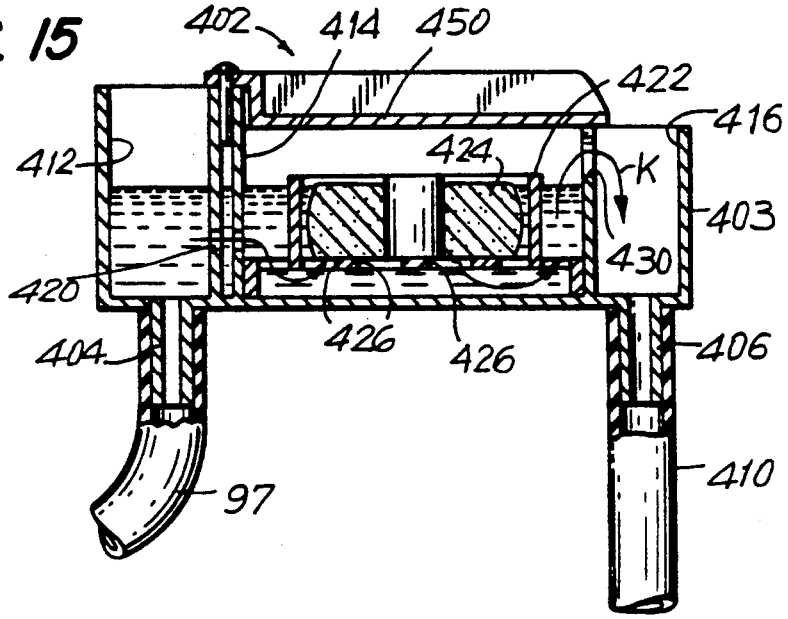
FIG. 15 is a front enlarged sectional view of the device for automatic delivery of toilet bowl freshener depicted in FIG. 13 constructed in accordance with the present invention.
Figure 14:
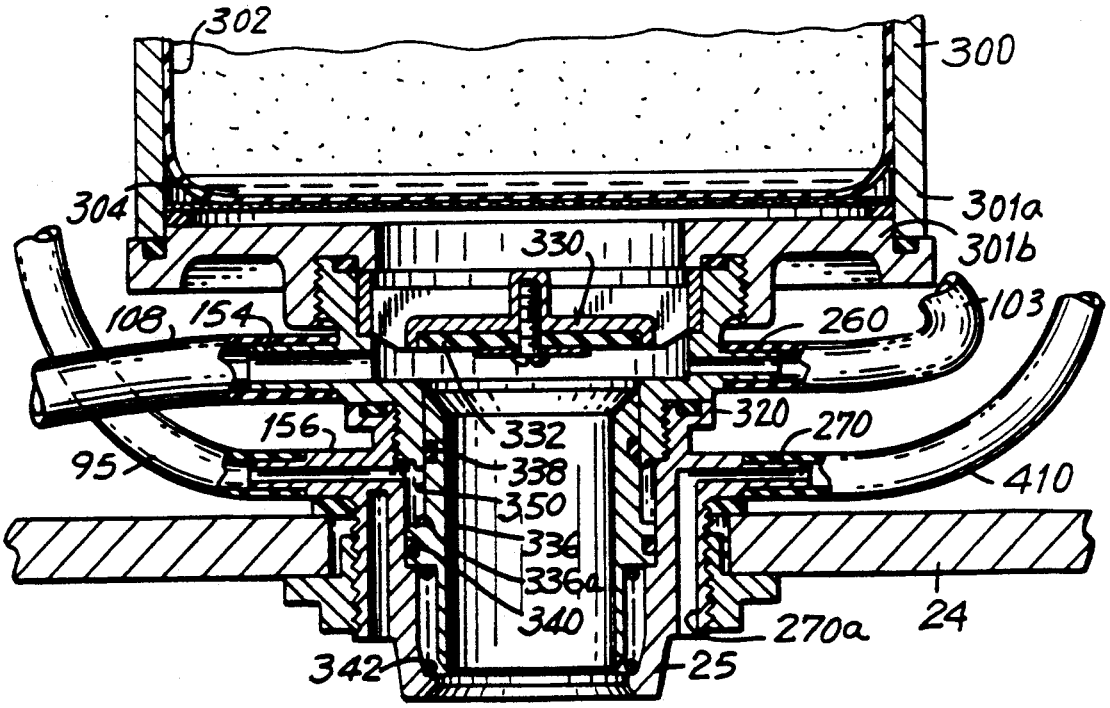
FIG. 14 is an enlarged partial side sectional view of the lower portion of the containment vessel depicted in FIG. 13 after flushing has occurred.

Reference is now made to FIGS. 13 through 15 which depict a third embodiment of a flushing mechanism using a phase change fluid having a toilet bowl freshening device, generally indicated at 400, constructed in accordance with the present invention. Like elements in FIGS. 13 and 14 and those shown in FIGS. 1 through 12 are numbered alike. Referring to FIG. 13, it is seen that toilet tank 24 is coupled through drain line 25 to the toilet bowl. Water supply line 26 supplies water under main system pressure to tank 24 as described above. A containment vessel 300 having a side wall 301*a*, a bottom wall 301*b* and a top wall or cover 301*c* is supported within tank 24 as depicted and is adapted to hold about 6 liters of water or other flushing liquid therein. Hydraulic actuation system 60 as described above in detail is utilized to actuate the flushing mechanism. It is noted that in the present embodiment, actuator button 62 is positioned on the side 24*b* of tank 24 and includes a pivotable actuator lever 62*a* to depress actuator button 62.

Unlike the elastic bladder system described above in connection with the second embodiment, the present embodiment utilizes a sealed collapsible bladder 302 adapted to hold a predetermined amount of a phase change fluid 304 which can be loaded into bladder 302 through a bladder fill nipple 303 in cover 301*c* of vessel 300. Before flushing, water 400 fills containment vessel 300 outside of bladder 302 and compresses bladder 302. While under pressure by the water in vessel 302, phase change fluid 304 is in a liquified state and is readily compressible to allow compression of bladder 302. However, when outside pressure is removed from bladder 302, phase change fluid 304 in liquid form will convert to a gaseous vapor state as shown in FIG. 14 thereby rapidly expanding bladder 302 to fill vessel 300 and force the water out as described below. A small amount of the fluid may remain in a liquid state. The potential energy stored in the working fluid as a compression of gas and phase change is released and transferred to the water as kinetic energy creating a high velocity flow under a relatively constant pressure of 15 psi exerted by the expanding bladder. Constant water pressure during the flushing operation provides excellent flushing performance.

The phase change fluid can be any appropriate fluid which changes from a liquid state to a gasified state when pressure thereon is reduced. An example of such a fluid is methyl chloride, but other appropriate phase change fluids may also be used. In order to provide a 6 liter flush with methyl chloride as the working fluid in the bladder, only about 13.5 grams of methyl chloride is required. In a liquid phase, this methyl chloride would have a volume of approximately 1.0 cubic inch. By comparison, a six liter flush system using compressed air as stored energy in accordance with the prior art at 30 psig requires about 3 liters, or 183 cubic inches for energy storage. Accordingly, the volume required for energy storage in the present embodiment is substantially less than in the prior art.

The flushing actuation system includes a flush valve cap 330 supported in a flush valve body 320 forming drain line 25 and includes a sealing plate 332 thereon. A displaceable flush valve 336 includes a first sealing ring 338 and a second sealing ring 340 to prevent leaks. A flush initiation chamber 350 is defined intermediate flush valve 336 and flush valve body 320. Flush valve 336 is normally biased upwardly against flush valve cap 330 (FIG. 13) through the action of a flush valve spring 342 thereby closing off the interior of containment vessel 300 to drain line 25 to permit water 400 to fill the vessel.

Flush valve body 320 includes a refill valve fitting 154 coupled to water supply line 108 and a flush valve fitting 156 coupled to flush actuation line 95. Flush initiation chamber 350 receives water under pressure from flush actuation line 95. Flush valve body 320 also includes a pressure feedback fitting 260 coupled to pressure feedback line 103 and a drain fitting 270 coupled to bowl freshener line 410. Drain fitting 270 includes an opening 270*a* to permit liquid in bowl freshener line 410 to flow into the toilet bowl.

In use, the hydraulic actuation system depicted in FIG. 4 and described above in detail is utilized to actuate the present embodiment under discussion. Before the flush cycle is commenced, the system is at rest with containment vessel 300 being filled with about 6 liters of water 400, and with collapsible bladder 302 in its collapsed state with phase change fluid 304 therein being in its liquified state as depicted in FIG. 13. All valves are closed in this condition.

The flush cycle is initiated as described above in detail with reference to FIG. 4 by depressing lever 62*a* which depresses actuator button 62. When actuator button 62 is depressed, flush actuation line 95 will be pressurized under the main system pressure and will thereby pressurize flush initiation chamber 350 to system supply pressure. This pressure will produce a downward force on shoulder 336*a* of flush valve 336 to overcome the force exerted by flush valve spring 342 to move flush valve 336 in a downward direction away from flush valve cap 330 as best depicted in FIG. 14 thereby opening containment vessel 300 to drain line 25. Water 400 in containment vessel 300 will be forced into drain line 25 around flush valve cap 330 as indicated by arrows H. As drain line 25 opens to containment vessel 300, the pressure exerted on collapsible bladder 302 by water 400 is reduced, and the phase change fluid will rapidly expand to its vapor phase as depicted in FIG. 14 providing constant pressure, namely the vapor pressure, to the water exiting through drain line 25 thereby creating a high velocity flow. A small amount of phase change fluid 304 may remain in a liquified state as depicted in FIG. 14. Bladder 302 essentially fills containment vessel 300 when expanded. As noted above, only about 6 liters of water are required for each flushing operation.

When the flushing operation has ended and flush valve cap 330 closes against flush valve body 336, water from water supply line 108 will enter through fitting 154 and refill containment vessel 300. Collapsible bladder 302 will experience the pressure exerted by water 400 as it fills containment vessel 300 and this pressure will cause phase change fluid 304 to reenter a liquified state. During the phase change, the heat of vaporization of the working fluid is absorbed by the water through the bladder wall. In order to facilitate such heat transfer, it may prove advantageous to use a metalized mylar balloon as the collapsible bladder.

Once containment vessel 300 is filled with water, the portion of the water in flush actuator line 103 which is released on closing of the system is forced through drain line 97 into bowl freshening device 400.

Toilet bowl freshening device 402 includes a dispenser housing or container 403 having a first fitting 404 and a second fitting 406. Drain line 97 from hydraulic actuation device 60 is coupled to fitting 404. Toilet bowl freshener line 410 from fitting 270 is coupled to middle fitting 406. Dispenser housing 403 includes a first or collecting chamber 412, a second chamber 414 and a third chamber 416. Dispenser housing 403 may be formed from a plastic material.

Water in drain line 97, when forced therethrough, will flow through fitting 404 into first chamber 412 and partially fill chamber 412. A conduit or flow passage 420 extending intermediate first chamber 412 and middle chamber 414 permits water in chamber 412 to flow into middle chamber 414. A bowl freshener support 422 is positioned in middle chamber 414 and is adapted to hold a pellet 424 of bowl freshener. Container 422 includes several openings 426 on the bottom thereof to permit the water in middle chamber 414 to flow into container 422 and wet pellet 424 thereby dissolving a portion of pellet 424 to create a concentrated solution of bowl freshener and water. Once the level of concentrated solution in middle chamber 414 extends above opening 430 extending intermediate middle chamber 414 and third chamber 416, a portion of the solution will flow in the direction of arrow K through fitting 406 and into bowl freshener line 410. From line 410, the solution will enter fitting 270 through opening **270*a*** and will then flow into the toilet bowl to freshen the water.

In operation, when the toilet is flushed, a volume of water essentially equal to the amount stored in the flush initiation chamber of the flushing mechanism during the actuation phase of the flush will be released through drain line 97 into collecting chamber 412 of dispenser 403. The water will then flow through passage 420 into a middle chamber 414 and will displace an equal volume of the concentrated solution therein causing such concentrated solution to flow out of the middle chamber 414 into chamber 416 and hence into line 410. The fresh water in the dispenser is exposed to the bowl freshener pellet, a portion of which dissolves to produce a fresh concentrated solution of water and bowl freshener.

The pellet of freshener 424 is readily replaceable when used up. A cover 450 on dispenser 403 can be moved to permit ready access thereto.

In accordance with the present invention, the small amount of water used during the hydraulic actuation of the various flushing mechanisms described above is no longer wasted, but can now be used in connection with the toilet bowl freshening device. Also, since only a small amount of water is used to dissolve the freshener, the freshener won't be wasted. Because the dispensing of the solution occurs at the end of the flush cycle after the flush valve has closed, the full volume of freshener remains in the bowl until the next flushing operation. The device can be readily mounted in a conventional toilet tank and used in connection with the devices disclosed above or any others which use hydraulic actuation.

Figure 16:
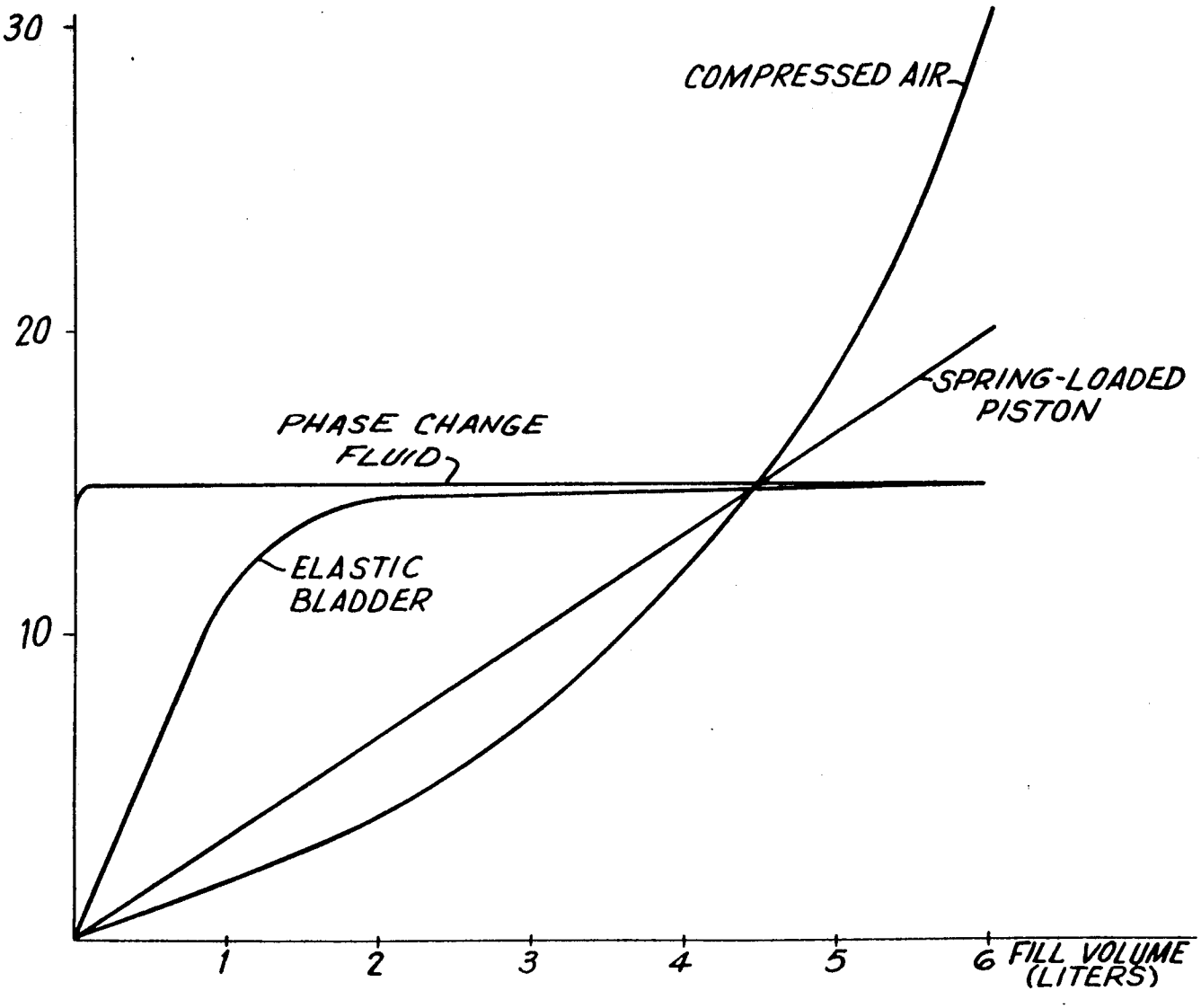
FIG. 16 is a graph showing fill volume versus pressure in several toilet flushing mechanisms.

Reference is now made to FIG. 16 which shows fill volume versus pressure for the three embodiments of the flushing mechanism described above for use in connection with the present invention, as well as for a compressed air system according to the prior art. It is seen that the spring-loaded piston embodiment shows a constant rise in pressure as the spring is compressed with a pressure of about 20 psi at 6 liter fill volume. The phase change fluid embodiment shows an essentially instantaneous rise in pressure with an essentially constant pressure of 15 psi regardless of the fill volume. The elastic bladder embodiment shows a rapid rise in pressure as it first expands with a pressure of about 15 psi at 6 liter fill volume. The conventional compressed air system shows an exponential increase in pressure as the air is compressed with a pressure of about 30 psi at 6 liter fill volume. The prior art compressed air system therefore requires a larger tank than is required in the present invention.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A toilet freshing device for use in conjunction with a toilet flushing mechanism for flushing a bowl with water supplied from a main supply, said toilet flushing mechanism being actuated by a hydraulic device and including a container means for holding a predetermined amount of said water under pressure, a flush valve coupled to said container means for selectively introducing said water under pressure in said container means into said bowl, an initiation chamber provided on said flush valve for receiving a portion of said water from said hydraulic device and for activating said flush valve in response thereto, said portion of said water in said initiation chamber being discharged therefrom after said flush valve has permitted release of said water under pressure therein, said toilet freshing device including a dispenser holding a predetermined amount of toilet bowl freshener, said dispenser having a first opening for receiving said portion of water supplied from said initiation chamber and a second opening coupled to said bowl, said toilet bowl freshener in said dispenser being mixed with said portion of water supplied to said dispenser from said initiation chamber, a portion of said mixture flowing through said second opening and into said bowl to freshen the water therein.

2. The bowl freshening device as claimed in claim 1, wherein said dispenser includes a first chamber for holding a portion of said water when introduced therein.

3. The bowl freshening device as claimed in claim 2, wherein said dispenser includes a second chamber for holding said toilet bowl freshener therein, said toilet bowl freshener being exposed to water from said first chamber to create a mixture of water and freshener.

4. The bowl freshening device as claimed in claim 3, wherein said dispenser includes a third chamber which receives said mixture of water and freshener and discharges said mixture through said second opening.

5. The bowl freshening device as claimed in claim 4, further comprising cover means for removably covering said second chamber.

6. The bowl freshening device as claimed in claim 1, wherein said dispenser includes a first chamber for receiving water from said hydraulic device through said first opening, a second chamber which supports said toilet bowl freshener therein in fluid communication with said first chamber, and a third chamber in fluid communication with said second chamber which receives the mixture of water and freshener from said second chamber and discharges same through said second opening.

7. The bowl freshening device as claimed in claim 6, further comprising cover means for removably covering said second chamber.

8. The bowl freshening device as claimed in claim 1, wherein said mixture flowing out of said second opening in said dispenser is supplied directly to said toilet bowl.

* * * * *